US007009129B2

(12) United States Patent
Vierling

(10) Patent No.: US 7,009,129 B2
(45) Date of Patent: Mar. 7, 2006

(54) SWITCHING DEVICE COMPRISING A BREAKER MECHANISM

(75) Inventor: Winfried Vierling, Neutraubling (DE)

(73) Assignee: Siemens Aktiengesellschaft, Munich (DE)

( * ) Notice: Subject to any disclaimer, the term of this patent is extended or adjusted under 35 U.S.C. 154(b) by 15 days.

(21) Appl. No.: 10/483,324

(22) PCT Filed: Jul. 5, 2002

(86) PCT No.: PCT/DE02/02476

§ 371 (c)(1),
(2), (4) Date: Jan. 12, 2004

(87) PCT Pub. No.: WO03/007322

PCT Pub. Date: Jan. 23, 2003

(65) Prior Publication Data

US 2004/0200711 A1 Oct. 14, 2004

(30) Foreign Application Priority Data

Jul. 12, 2001 (DE) ..... 101 33 878

(51) Int. Cl.
*H01H 5/00* (2006.01)

(52) U.S. Cl. ..... 200/400; 200/401; 335/16; 335/147

(58) Field of Classification Search ..... 200/400, 200/401; 335/8–10, 200, 16, 147, 195, 167
See application file for complete search history.

(56) References Cited

U.S. PATENT DOCUMENTS

| | | | | |
|---|---|---|---|---|
| 4,968,863 | A | | 11/1990 | Rezac et al. |
| 5,053,590 | A | * | 10/1991 | Vierling ..... 200/293 |
| 5,302,788 | A | * | 4/1994 | Link et al. ..... 200/401 |
| 5,478,979 | A | * | 12/1995 | Castonguay et al. ..... 200/400 |
| 5,534,833 | A | * | 7/1996 | Castonguay et al. ..... 335/68 |
| 5,723,836 | A | * | 3/1998 | Okuno et al. ..... 200/501 |
| 5,973,280 | A | * | 10/1999 | Gula et al. ..... 200/339 |
| 6,087,913 | A | * | 7/2000 | Castonguay et al. ..... 335/16 |

FOREIGN PATENT DOCUMENTS

| | | |
|---|---|---|
| DE | 1563781 | 4/1970 |
| DE | 3034790 | 3/1982 |
| DE | 3423541 | 1/1986 |
| DE | 4116454 | 11/1992 |
| DE | 19735408 | 2/1999 |
| DE | 19919420 | 11/2002 |
| GB | 1468569 | 3/1977 |

* cited by examiner

*Primary Examiner*—Richard K. Lee
(74) *Attorney, Agent, or Firm*—Harness, Dickey & Pierce, P.L.C.

(57) ABSTRACT

A switching device including housing and a breaker mechanism, the latter consisting of a trip lever, a catch, a displaceable contact arm and a deflection shaft that is fixed to the housing. The aim is to generate a constant contact force. To achieve this, the end of the catch is coupled to the displaceable contact arm by way of a bolt. The bolt is configured to be displaced in a receiving element that is formed by the housing.

17 Claims, 2 Drawing Sheets

SWITCHING DEVICE COMPRISING A BREAKER MECHANISM

This application is the national phase under 35 U.S.C. § 371 of PCT International Application No. PCT/DE02/02476 which has an International filing date of Jul. 5, 2002, which designated the United States of America and which claims priority on German Patent Application number DE 101 33 878.3 filed Jul. 12, 2001, the entire contents of which are hereby incorporated herein by reference.

FIELD OF THE INVENTION

The invention generally relates to a switching device.

BACKGROUND OF THE INVENTION

A switching device, in particular a protective switching device, having a latching mechanism is used, for example, as a circuit breaker. Circuit breakers—also referred to as automatic circuit breakers—are predominantly used today in place of fuses. Circuit breakers are overcurrent circuit breakers having a first and a second tripping device which act on a latching mechanism. An electromagnetic tripping device effects instantaneous tripping in the event of a short circuit. A thermal bimetallic tripping device switches off in the event of permanent overloads when the affected line is excessively heated. The latching mechanism can also be actuated by use of a manually operable switching toggle, by means of which the respective circuit breaker can also interrupt a circuit.

A protective switching device is disclosed in DE 199 19 420 A1. Furthermore, such a circuit breaker is also disclosed, for example, in U.S. Pat. No. 4,968,863. The contact force between a stationary, first contact piece and a second contact piece arranged on a moveable contact arm is an important parameter for circuit breakers. The circuit breaker of the prior art cited above does have, however, a construction which unfavorably influences this parameter.

SUMMARY OF THE INVENTION

It is therefore an object of an embodiment of the invention to propose a switching device which provides a constant contact force.

An object may be achieved by a switching device in which, according to an embodiment of the invention, the bolt is guided in an accommodating element, formed by the enclosure, such that it can be displaced.

DE 34 23 541 A1 also discloses a circuit breaker having a latching lever which is guided in a link in a side wall of an enclosure in order to fix a latching mechanism in position.

The switching device according to an embodiment of the invention provides a constant contact force between the two contact pieces. The constant contact force is additionally provided using a small number of device components, which can make a cost-effective construction of the latching mechanism and thus of the switching device possible.

The guiding function is in this case provided by the bolt which is guided in an accommodating element, formed by the enclosure, such that it can be displaced. Owing to this configuration, transverse forces caused by the deflection pin are no longer produced at the contours of the cutout of the moveable contact arm. As a consequence, it is possible to avoid the contact force being reduced and the device temperature being increased by friction losses caused by transverse forces.

Furthermore, the constructional design freedom as regards the different positions of the latching mechanism and adjacent device components in the switching device remains unaffected by the novel configuration of the latching mechanism. In particular, there is no need to consider the lines of action, which are aligned largely parallel to one another, of the forces of the contact, a tension spring and the latch. An element for compensating for any transverse forces which may occur can accordingly also be dispensed with. Advantageously, the accommodating element is in the form of a molded-on part of the enclosure. This provides a simple integral unit which can be produced as a cast or molded part. This results in a favorable cost reduction for the manufacture and assembly of the individual device components.

In a further configuration, the accommodating element is in the form of a separate enclosure part and can be arranged in the enclosure such that its position can be altered. This makes it advantageously possible for it to be adapted to different demands of the switching device, in particular to the kinematics and the effective forces.

The accommodating element is preferably in the form of an arcuate link which has an arcuate opening. The resultant movement sequence of the moveable contact arm is thus necessarily guided and optimized depending on the embodiment of the switching device.

The cutout is advantageously open or closed, thus providing a further potential saving and simplification in terms of the assembly of the device components, in particular the moveable contact arm.

The enclosure advantageously includes two enclosure shells, each having an accommodating element, the bolt being guided on both sides. This results in high guidance stability and a precise movement sequence.

The enclosure is preferably made of insulating material. In this case, the insulating properties of the insulating material are useful to the extent that they satisfy existing regulations on protection against electric shock. Further, in addition, they effect electrical and thermal decoupling between the device components and subassemblies.

BRIEF DESCRIPTION OF THE DRAWINGS

Further advantages, features and details of the invention will become evident from the description of illustrated embodiments given hereinbelow and the accompanying drawing, which is given by way of illustration only and thus is not limitative of the present invention, wherein.

In the text which follows, identical parts in the figures are provided with identical reference numerals or analogously with similar reference numerals.

DETAILED DESCRIPTION OF THE PREFERRED EMBODIMENTS

Figure 1:
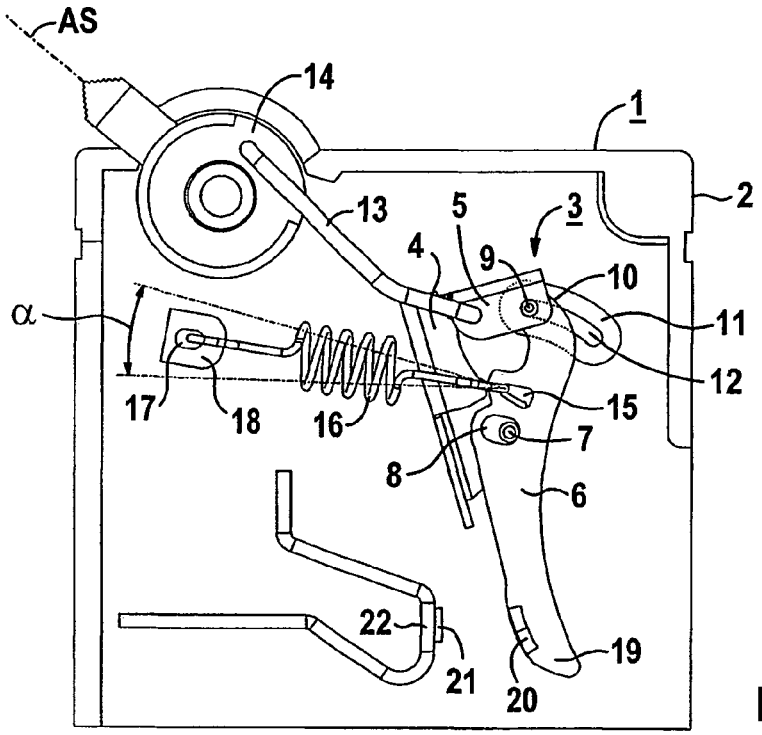
FIG. 1 shows a switching device having a latching mechanism in the off position.

FIG. 1 shows a switching device 1 having an enclosure 2 and a latching or breaker mechanism 3 in the so-called off position AS. The latching mechanism 3 has a tripping lever 4, a latch 5, a moveable contact arm 6 and a deflection pin 7 fixed to the enclosure. The contact arm 6 has in this view an approximately mirror-reversed S shape and is provided approximately mid-way, in particular at a length ratio of 1:2, along its component length with a cutout 8, in which the deflection pin 7 is arranged.

The cutout 8 may be either open or closed and is directed essentially toward the tripping lever 4 with respect to the component width of the contact arm 6. The cutout 8 is larger than the deflection pin 7, which simplifies the assembly of the device components. The cutout 8, in conjunction with the deflection pin 7, serves only to hold the device components together. The deflection pin 7 is arranged largely freely in the cutout 8 and performs a limiting or deflecting function, possibly in the form of a stop.

The latch 5 is coupled at one end to a first end 10 of the contact arm 6 by means of a bolt 9. The bolt 9 is for its part guided in an accommodating element 11, formed by the enclosure 2, such that it can be displaced.

The accommodating element 11 may also be in the form of an arcuate link, the accommodating element 11 and possibly the link equally having an arcuate opening 12. The accommodating element 11 may be in the form of both a molded-on part of the enclosure 2 and a separate enclosure part. The separate enclosure part may be arranged in the enclosure 2 such that its position can be altered, thus providing a large number of design possibilities. At the end opposite from the side coupled with a bolt at one end, the latch 5 is connected to a bracket 13, which in turn is operatively connected to a toggle drum 14. The enclosure 2, which may be made of insulating material, may comprise two enclosure shells, each having an accommodating element 11, the bolt 9 being guided on both sides.

Between the cutout 8 and the bolt 9, the contact arm 6 has an engagement opening 15 in which a tension spring 16 can engage. The tension spring 16 is also accommodated in an accommodating opening 17 in a holder 18 and thus is subject to pre-stress. The holder 18 can be mounted or displaced in a first angle range a such that, advantageously, different positions of the tension spring can have different contact forces, as a result of which definable types of switching device can be determined. On a second end 19 of the contact arm 6, a first contact piece 20 is arranged at approximately the same height as a second contact piece 21. The second contact piece 21 is placed on a stationary contact support 22, which is part of a unit not described in any more detail here.

In contrast to a conventional latching mechanism, the latching mechanism 3 has, in addition to the deflection pin 7, the accommodating element 11, which acts as a pivoting and swiveling element for the moveable contact arm 6. The moveable contact arm 6 is thus guided not by a combination of the deflection pin 7 and the cutout 8 but by the accommodating element 11, its opening 12 and the bolt 9 guided in the opening.

Figure 2:
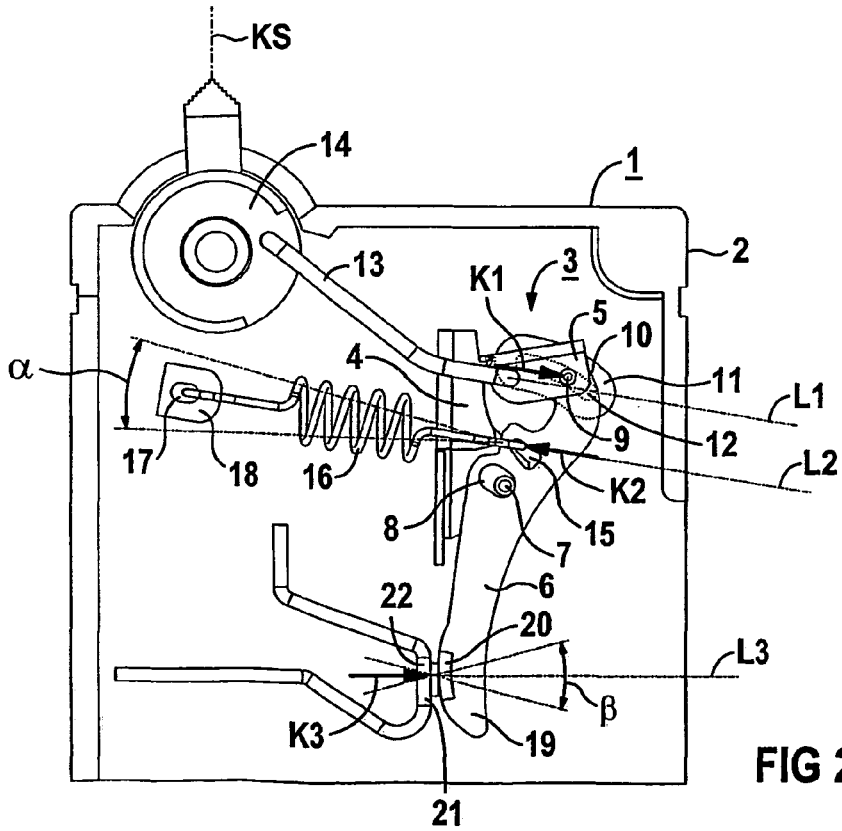
FIG. 2 shows a switching device as shown in FIG. 1 in the contact position.

If the toggle drum 14 is actuated so as to switch over from the off position AS to the so-called contact position KS as shown in FIG. 2, the toggle drum 14 transfers its rotational movement into a translational movement on the bracket 13. The bracket 13 in turn transfers the translational movement by means of a latch force K1 to the latch 5 and then the latter causes the contact arm 6, by way of the associated bolt 9, to carry out an arcuate swiveling movement. Owing to the force effect of the tension spring 16 by way of a tension spring force K2, the tripping lever 4 pivots at the same time and to the same extent, and in the process is overlapped by the latch 5 to an increasing extent.

FIG. 2 shows the switching device 1 as shown in FIG. 1 in the contact position KS. A temporary intermediate position of the latching mechanism 3, in which the two contact pieces touch, is referred to as the contact position KS. In this case, the bolt 9 slides in the opening 12 in the accommodating element 11 which acts as an arcuate enclosure groove. The accommodating element 11 is arranged centrically about the deflection pin 7 of the contact arm 6. The first contact piece 20, associated with the contact arm 6, rests on the second contact piece 21, without the full contact force K3 being effective. The first angle range $\alpha$, given by the variable holder 18, is mirrored by a second angle range $\beta$—determined by the kinematics of the latching mechanism 3—at the point at which the contact pieces 20, 21 touch.

Transverse forces acting on the contact arm 6 are directed via the bolt 9 into the accommodating element 11 and not via the deflection pin 7 onto the inner contours of the cutout 8. A small radius at the bolt 9 favors friction losses which may occur. Advantageously, disruptive transverse forces are considerably reduced, which produces a constant contact force K3 even if the number of device components is low—i.e. when there are no device components which compensate for tipping moments. Furthermore, the lines of action of the forces of the latch, the tension spring and the contact L1, L2 and L3, respectively, no longer need to be arranged parallel to one another in order to keep any transverse forces which may occur low.

Figure 3:
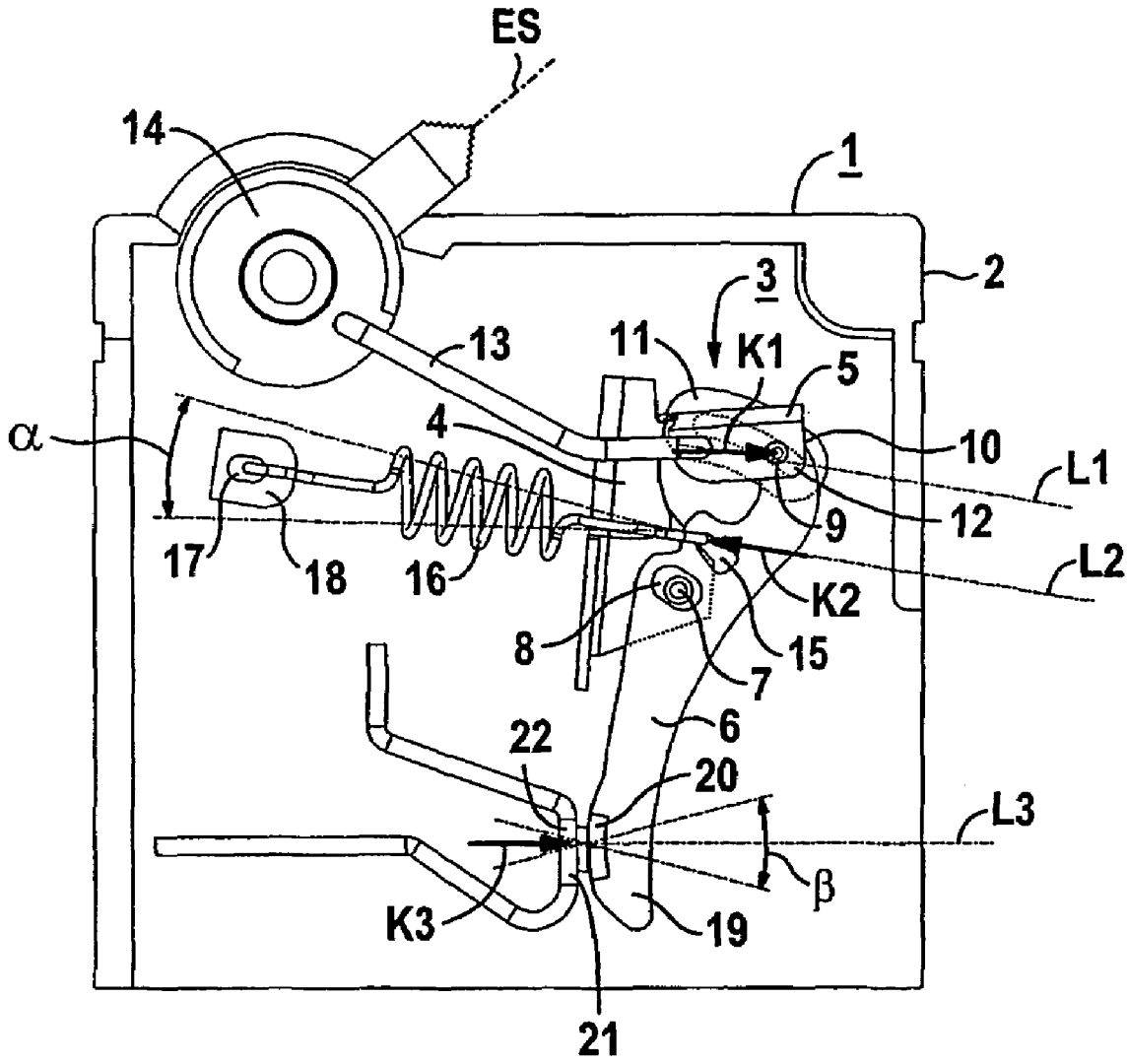
FIG. 3 shows a switching device as shown in FIG. 1 in the on position.

FIG. 3 shows the switching device 1 as shown in FIG. 1 in the so-called on position ES. In this case, the full contact force K3 acts on the two contact pieces 20, 21, since the latch 5 largely overlaps the tripping lever 6 and latches with it, and the contact arm 6 in the process displaces the latching mechanism 3 into the tripping position by way of the toggle effect.

The important concept of this idea is to displace the guidance of the moveable contact arm from the cutout with the deflection pin arranged therein to the bolt guided in the accommodating element.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A switching device, comprising:

an enclosure; and a mechanism, including a tripping lever, a latch, a moveable contact arm and a deflection pin fixed to the enclosure, the moveable contact arm including a cutout in which the deflection pin is arranged, and the latch being coupled at one end to the moveable contact arm via a bolt, wherein the bolt is displaceable in an accommodating element formed by the enclosure.

2. The switching device as claimed in claim 1, wherein the accommodating element is formed as a molded-on part of the enclosure.

3. The switching device as claimed in claim 2, wherein the accommodating element is arrangeable in the enclosure.

4. The switching device as claimed in claim 2, wherein the accommodating element is in the form of an arcuate link with an arcuate opening.

5. The switching device as claimed in claim 2, wherein the enclosure includes two enclosure shells, each having an accommodating element, the bolt being guidable on both sides.

6. The switching device as claimed in claim 2, wherein the enclosure is made of insulating material.

7. The switching device as claimed in claim 1, wherein the accommodating element is arrangeable in the enclosure.

8. The switching device as claimed in claim 7, wherein the accommodating element is in the form of an arcuate link with an arcuate opening.

9. The switching device as claimed in claim 7, wherein the enclosure includes two enclosure shells, each having an accommodating element, the bolt being guidable on both sides.

10. The switching device as claimed in claim 7, wherein the enclosure is made of insulating material.

11. The switching device as claimed in claim 1, wherein the accommodating element is in the form of an arcuate link with an arcuate opening.

12. The switching device as claimed in claim 11, wherein the enclosure includes two enclosure shells, each having an accommodating element, the bolt being guidable on both sides.

13. The switching device as claimed in claim 11, wherein the enclosure is made of insulating material.

14. The switching device as claimed in claim 1, wherein the cutout is at least one of open and closed.

15. The switching device as claimed in claim 1, wherein the enclosure includes two enclosure shells, each having an accommodating element, the bolt being guidable on both sides.

16. The switching device as claimed in claim 1, wherein the enclosure is made of insulating material.

17. A breaker mechanism, comprising:

a tripping lever;

a latch;

a moveable contact arm; and a deflection pin fixed to an enclosure of a switching device, the moveable contact arm including a cutout in which the deflection pin is arranged, and the latch being coupled at one end to the moveable contact arm via a bolt, wherein the bolt is displaceable in an accommodating element formed by the enclosure.

* * * * *